United States Patent [19]

Osenberg et al.

[11] Patent Number: 4,763,484

[45] Date of Patent: Aug. 16, 1988

[54] METHOD OF AND APPARATUS FOR THE COOLING OF UNDERGROUND MINE SHAFTS AND/OR MACHINERY INSTALLED THEREIN

[75] Inventors: Kurt A. Osenberg, Wilnsdorf; Michael Kortenbusch, Unna, both of Fed. Rep. of Germany

[73] Assignee: SMS-Schloemann-Siemag Aktiengesellschaft, Dusseldorf, Fed. Rep. of Germany

[21] Appl. No.: 53,095

[22] Filed: May 21, 1987

[30] Foreign Application Priority Data

Jun. 7, 1986 [DE] Fed. Rep. of Germany ..... 3619216

[51] Int. Cl.[4] ..... F25D 23/12

[52] U.S. Cl. ..... 62/99; 62/260; 299/18

[58] Field of Search ..... 62/99, 185, 201, 260, 62/434; 299/18

[56] References Cited

U.S. PATENT DOCUMENTS 4,143,922 3/1979 Sweeney ..... 299/18 X
4,144,718 3/1979 Williams ..... 62/98 X
4,251,108 2/1981 Nocke ..... 299/18 X

FOREIGN PATENT DOCUMENTS 2457943 11/1975 Fed. Rep. of Germany .
3212108 7/1983 Fed. Rep. of Germany .
3040283 9/1985 Fed. Rep. of Germany .

*Primary Examiner*—William E. Wayner
*Attorney, Agent, or Firm*—Herbert Dubno

[57] ABSTRACT

For cooling of underground mine-shafts which extend over several levels at different depths and/or of the machinery installed therein, a tube-chamber feeder system which is operated for the hydraulic transport of solids is used. With this arrangement, the cooling liquid is supplied to the feeder system and to the high-pressure side of the tube chambers from above ground level through a high-pressure circulation of the cooling liquid and subsequently the cooling liquid from the tube chambers is forced through a low-pressure liquid circulation for transfer to the equipment requiring cooling. The essential requirement here is that the cold water which serves as the cooling liquid should be first of all fed from the feeder system into the tube-chambers which are located on the different levels of the mine-shaft respectively, following which each of these tube-chambers should be supplied separately, if the occasion demands, with hot-, or re-cycled-, water obtained from the equipment which required cooling, from their own low-pressure liquid circulation, for the purpose of expelling the cooling liquid towards the mining equipment requiring cooling.

11 Claims, 8 Drawing Sheets

Figure 1A:
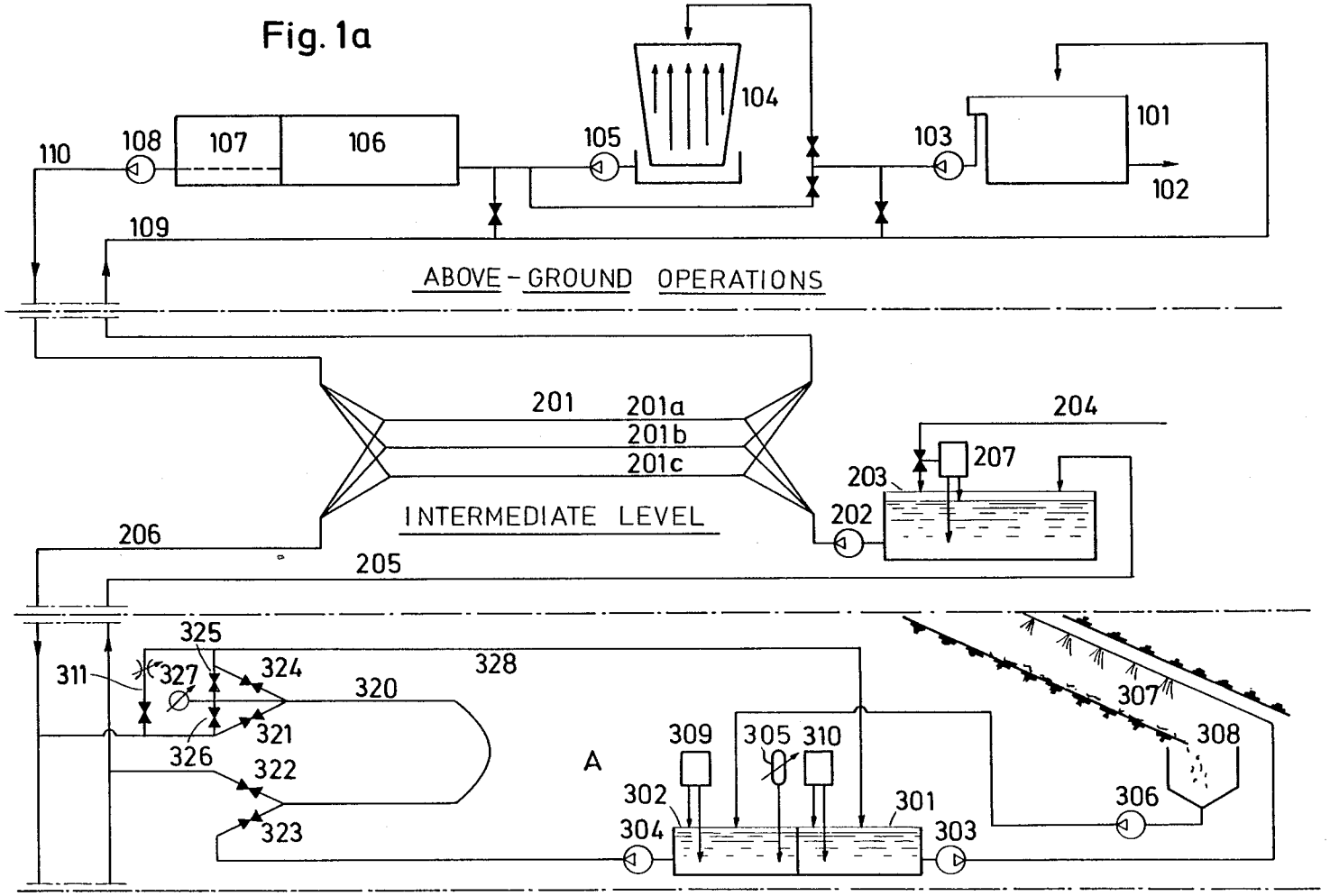

CYCLIC DELIVERY PROGRAM
A
B
C
D
B
C
DELIVERY 320 A-LEVEL
FILLING
DELIVERY 420 B-LEVEL
FILLING
DELIVERY 520 C-LEVEL
FILLING
DELIVERY 620 D-LEVEL
FILLING
$T_{Fö}$
$T_{Fü}$
$T_B$
$T_{SCH}$
1
2
3
4
5
6
7
8
$T_{Fö}$ = DELIVERY TIME
$T_{Fü}$ = FILLING TIME
$T_{SCH}$ = SWITCHING TIME
$T_B$ = WAITING TIME

METHOD OF AND APPARATUS FOR THE COOLING OF UNDERGROUND MINE SHAFTS AND/OR MACHINERY INSTALLED THEREIN

FIELD OF THE INVENTION

The present invention relates to a method of and an apparatus for the cooling of underground mine shafts which extend over several levels at different depths and/or of the machinery installed therein using a tube-chamber feeder system which is operated for the hydraulic transport of solids. With this arrangement, the cooling liquid is supplied to the feeder system and to the high-pressure side of the tube chambers from above ground level through a high-pressure circulation path and subsequently the cooling liquid from the tube chambers is forced through a low-pressure liquid circulation path for transfer to the equipment requiring cooling.

BACKGROUND OF THE INVENTION

It is already known that the tube-chamber feeder system which is generally operated for the hydraulic transport of solids can also be used for cooling the atmosphere in mine shafts and/or the machinery installed therein, as may be gleaned from the disclosures in German Patent Specification DE-PS No. 30 40 283 and German Offenlegungsschrift DE-OS No. 32 12 108. These tube-chamber feeder systems are connected to a low-pressure liquid circulation which is furnished with a feed pump for the purpose of filling all the tube chambers with heated liquid. By this means the cooling liquid which is fed into the tube chambers by the high-pressure circulation is forced out from the tube-chambers and forwarded to the equipment requiring cooling.

In the case of underground mine-shafts which extend over several levels at different depths, there is necessarily a very widespread and extensive system of network pipelines for discharging into a plurality of different items of low-temperature equipment. These items of low-temperature equipment are installed on the different levels, and therefore at different depths in the mine shaft. Their locations may need to be changed frequently due to the progress of the mining excavation or due to other exigencies which arise in the mine shaft. These circumstances can also give rise to pressure fluctuations which, as would be expected, have a deleterious effect on the performance of the cooling equipment.

The adaptation of such cooling equipment, which is subject to continual pressure fluctuations, to provide optimal operating conditions, demands the expenditure of a great amount of effort on technical control methods, as well as the permanent employment of trained technical personnel which, in its turn, detracts from the overall economy of the cooling equipment.

OBJECTS OF THE INVENTION

The principal object of the present invention is to overcome these inadequacies.

Therefore, a problem to be solved by the invention is the provision of a method of cooling of the type referred to initially which is not subject to pressure fluctuations because of alteration of location of the equipment or because of differences in depth below the surface, and which also allows for simplified technical control procedures, as well as improved economy of operations.

It is also an object of the invention to provide apparatus for carrying out this method which operates, on the one hand, with a tube-chamber feeder system connected by way of pipelines of a high-pressure circulation in the mine-shaft to refrigeration equipment located above ground level and connected, on the other hand, by way of a low-pressure liquid circulation, to the equipment which requires cooling.

SUMMARY OF THE INVENTION

According to the method aspect of the invention, the cooling liquid is supplied to the tube chamber at the different levels and its overall cooling capacity is varied during the supply operation by regulation of the quantity for each of the different levels. Subsequently, the separate tube chamber are supplied through their own low-pressure liquid circulation with hot or re-circulated water derived from the cooled equipment in order to force out the cooling liquid and transfer it to the equipment which requires cooling.

The method of operation in accordance with the invention offers the advantage that it can be adapted to the most widely differing types of mine operations and it can be varied or modified at any later stage without any problems but, in spite of this, there is no impairment of the cooling effect which could occur due to pressure fluctuations.

The regulation of the amount of cooling liquid for the individual level can be determined by the volume, or dimensions, of the particular tube-chamber associated with each of the levels.

Under these conditions, the tube chamber can be designed in advance to suit the requirements of the cooling capacity needed at each particular level.

However, it has been found to be especially advantageous if the regulation of the quantity of cooling liquid for the individual levels is varied in accordance with the number of successive filling operations for the tube chamber associated with each of the levels.

In this way it is possible, not only to install structurally similar tube chambers at all levels, but also, at any subsequent time, to vary the cooling capacity in line with the requirements of the individual levels by alteration of the frequency of coupling the various tube chamber into the circulation system.

The apparatus for carrying out the method comprises a tube-chamber feeder system connected by way of pipelines of a high-pressure circulation in the mine shaft to centralized refrigeration equipment located above ground level and connected by way of a low-pressure liquid circulation, to the equipment which requires cooling. According to the invention by the fact that there is at least one tube chamber located at each level of the mine shaft, and that the total number of tube chambers is connected to one feeder system in common, each of the tube chambers is supplied through the low-pressure liquid circulation which connects them to the equipment requiring cooling, and the tube chambers at the various levels are of different lengths and have different fill volumes.

Alternatively, use of a different type of construction of the equipment for there is at least one tube chamber located at each level of the mine shaft, and the total number of tube chambers is connected to one feeder system in common, each of the tube-chambers being supplied through the low-pressure liquid circulation which connects them to the equipment requiring cooling, and the tube chambers at the various levels which are of the same length and have the same fill volumes are designed in such a manner that they can be switched on or off for different frequencies of filling.

A central control system serves for the control of the tube chamber feeder system in accordance with the invention and this central system may be influenced by signals received from instruments for measuring pressure or for measuring temperature, from limit switches for shut-off devices, timing relays, integrators and instruments for measuring volumes or weights, all of which may be associated with the various tube-chambers.

Each of the tube chambers can be selectively connectable to the high-pressure cooling liquid circulation by way of delivery gate valve and by way of a filler gate valve with the low-pressure liquid circulation. Moreover, the important thing for a well-regulated operation of the equipment is that there should also be a pressure-relief valve and a pressure-increase valve provided between the delivery gate valve and the filler gate valve for the low-pressure liquid circulation and between each of the said pressure valves there should be a contact manometer.

BRIEF DESCRIPTION OF THE INVENTION

Figure 1B:
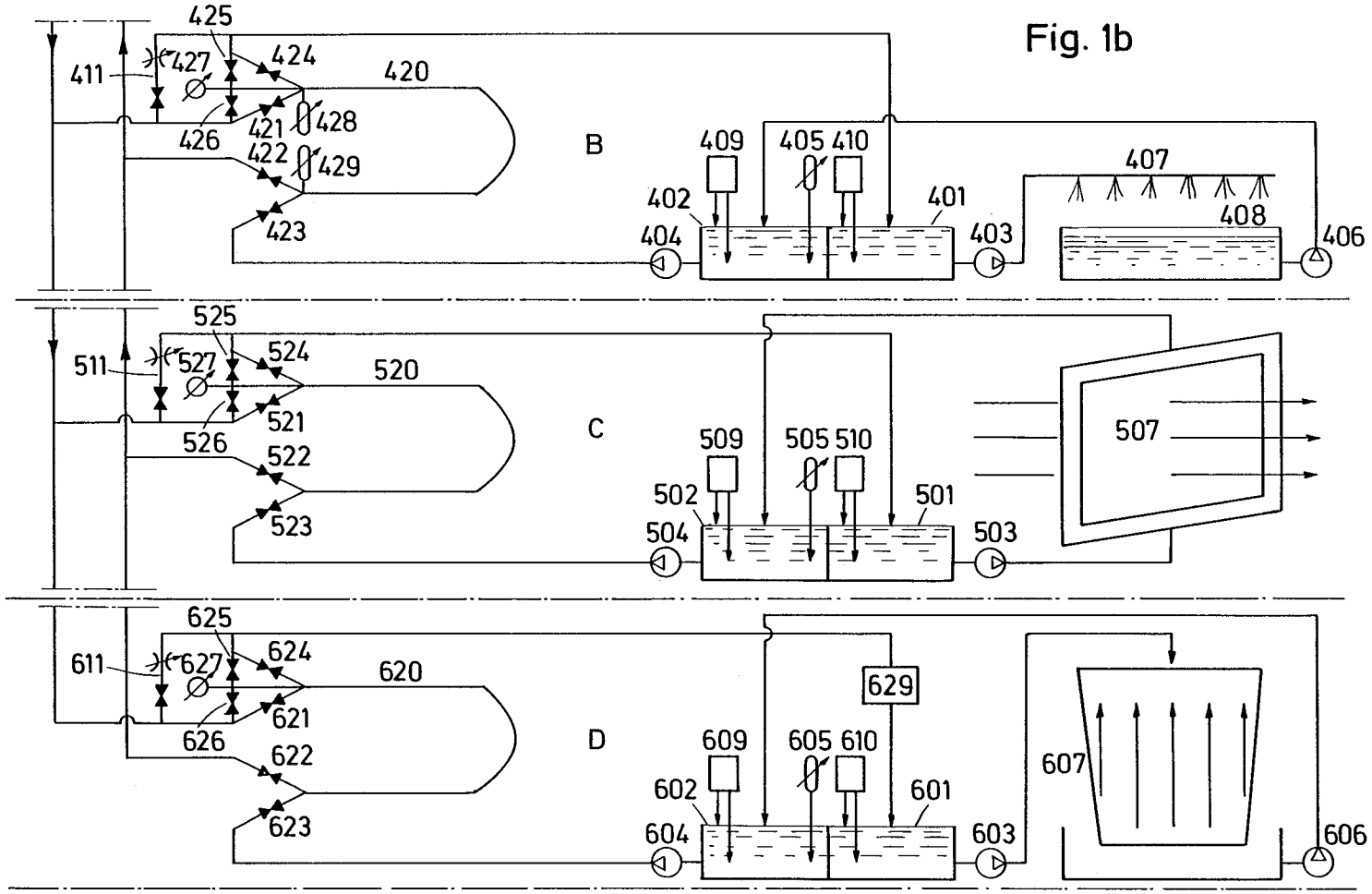
Figure 2:
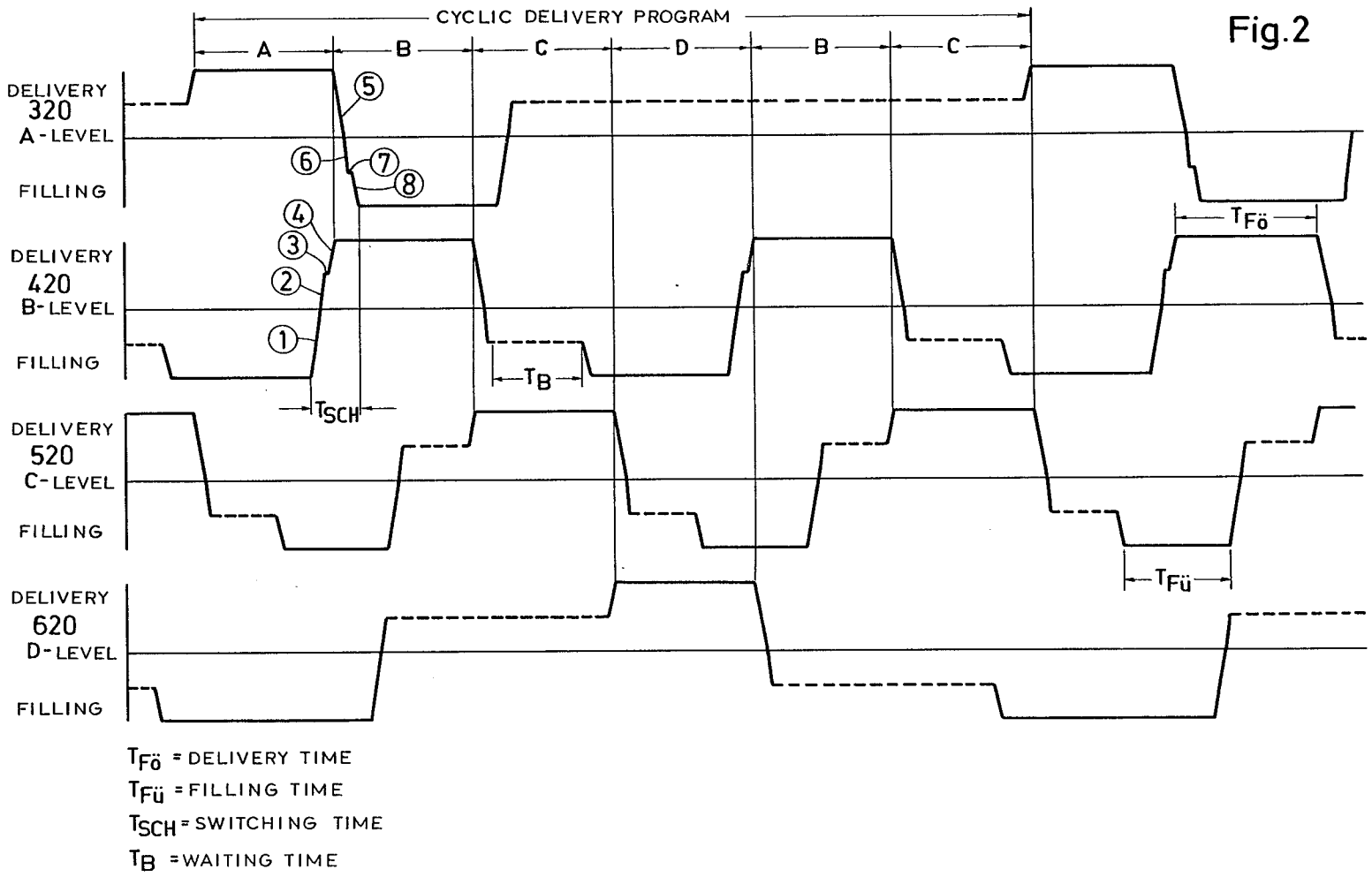
Figure 3:
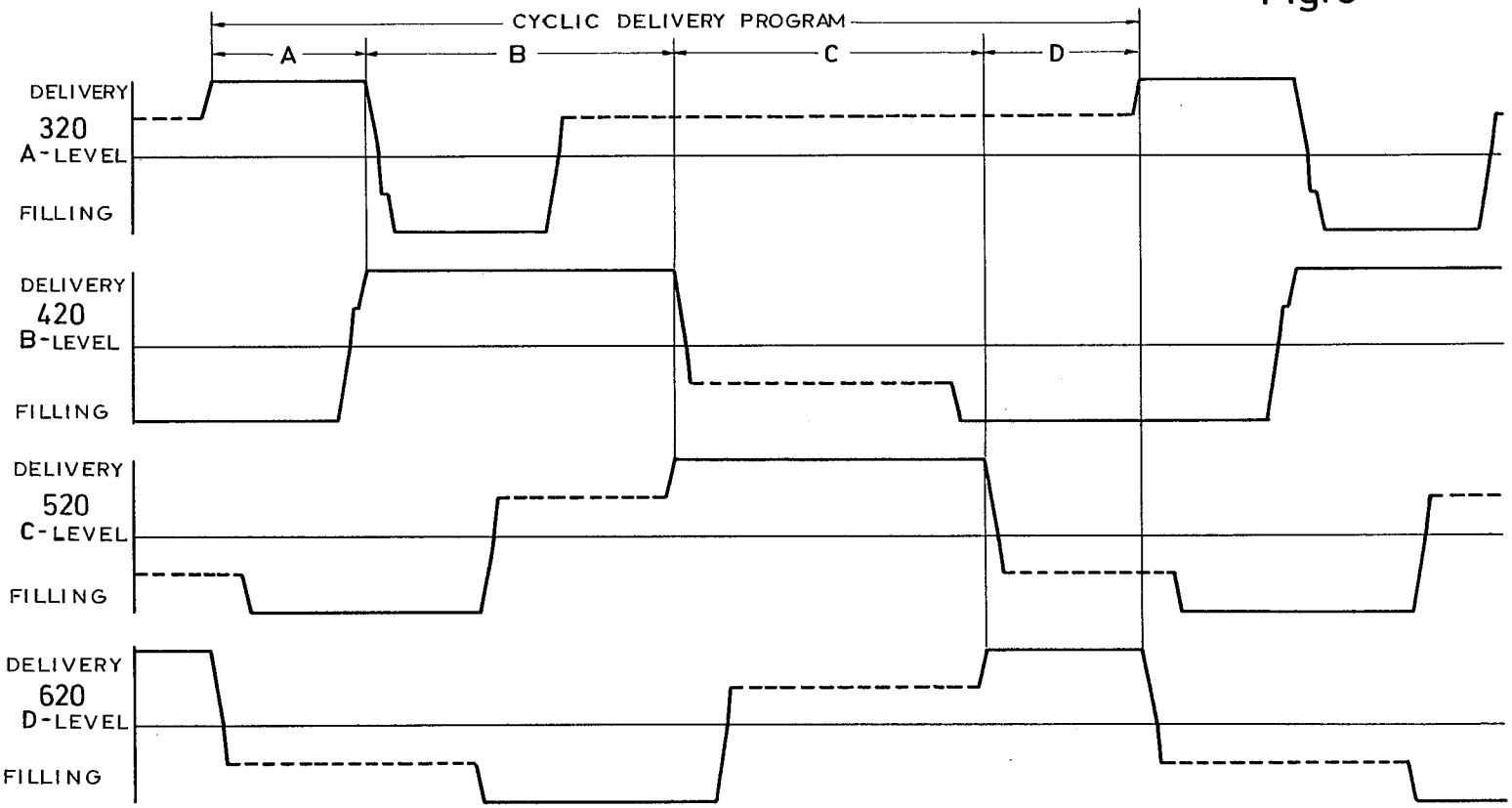
Figure 4A:
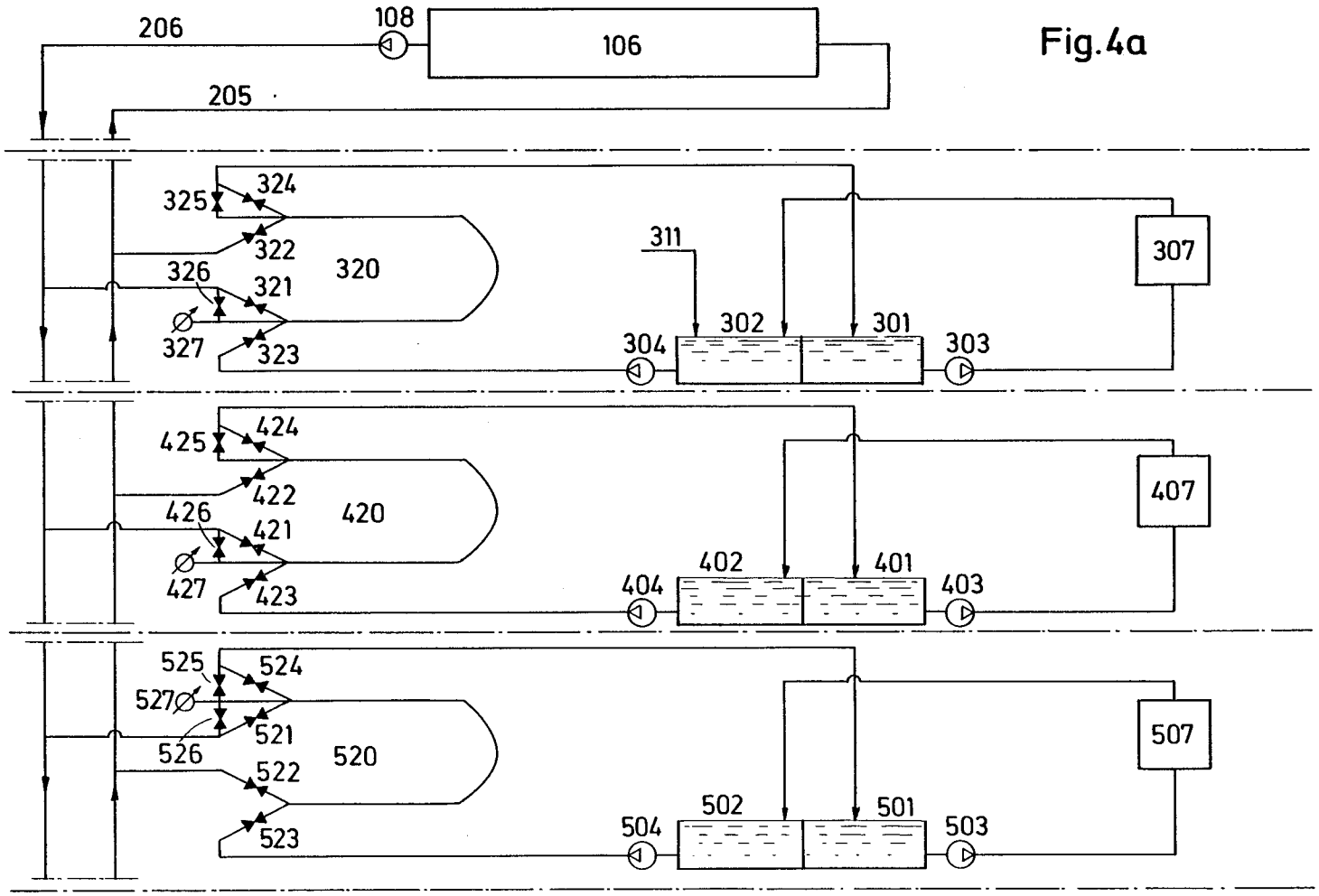
Figure 4B:
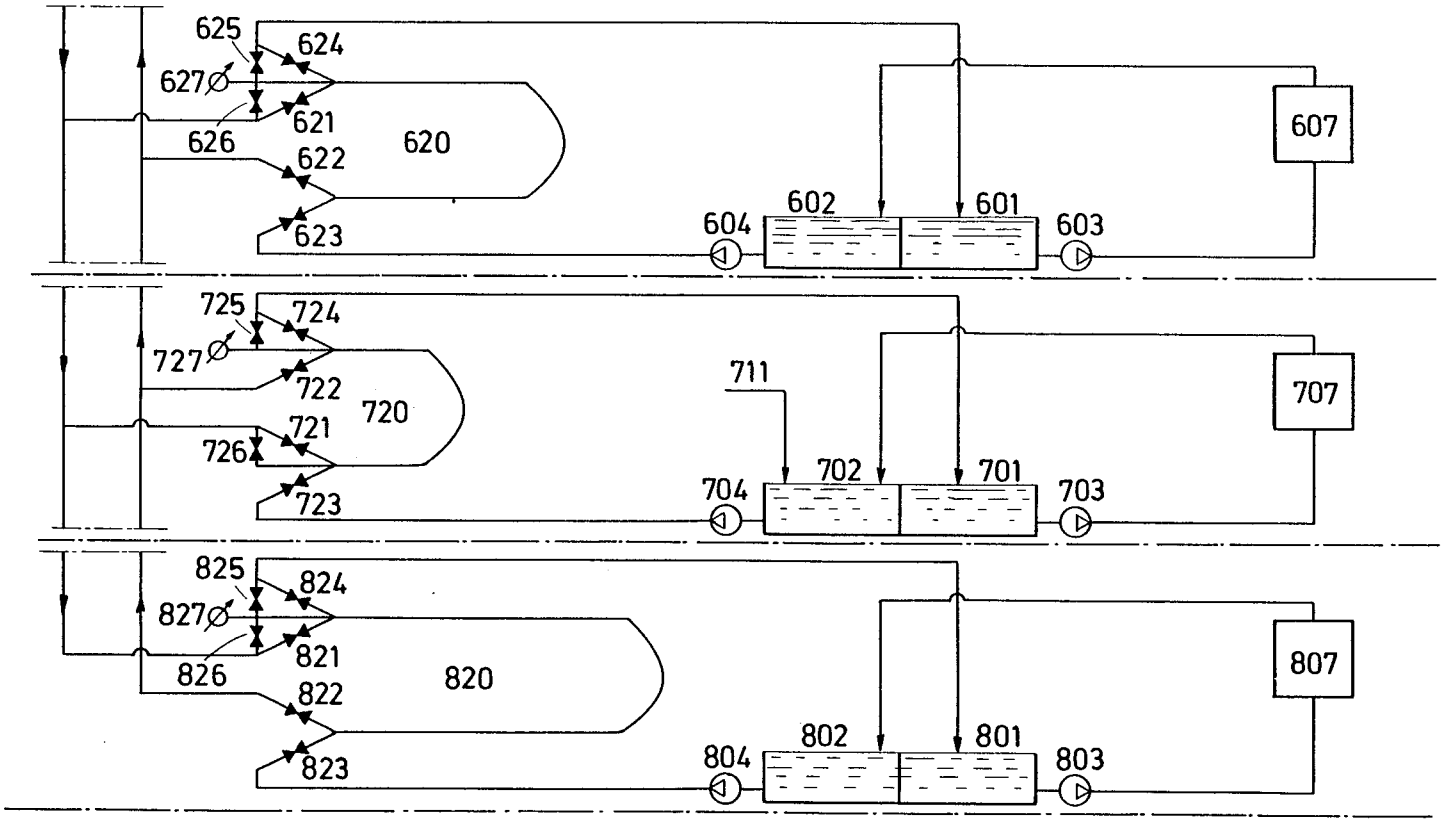
Figure 5:
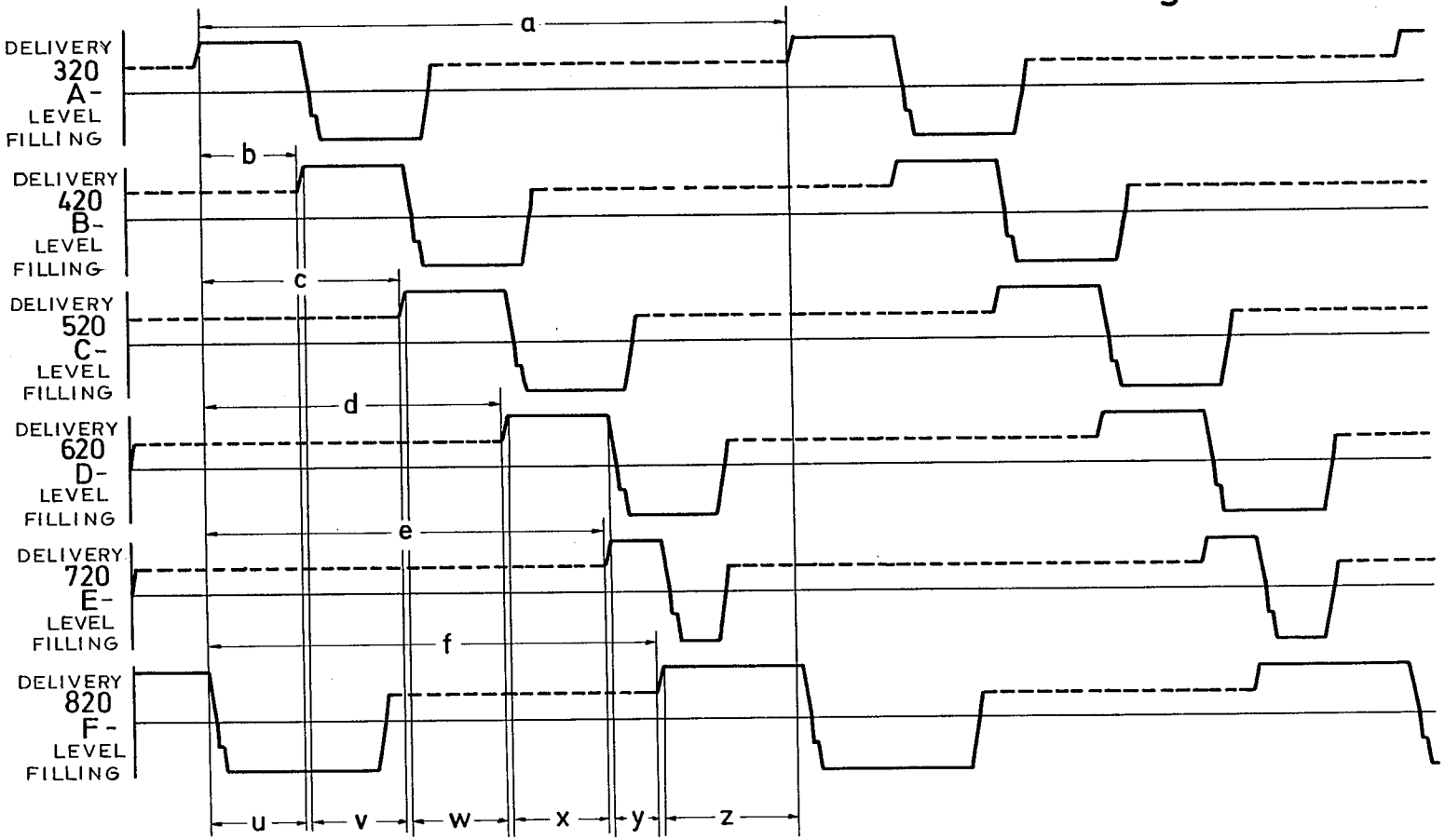
Figure 6:
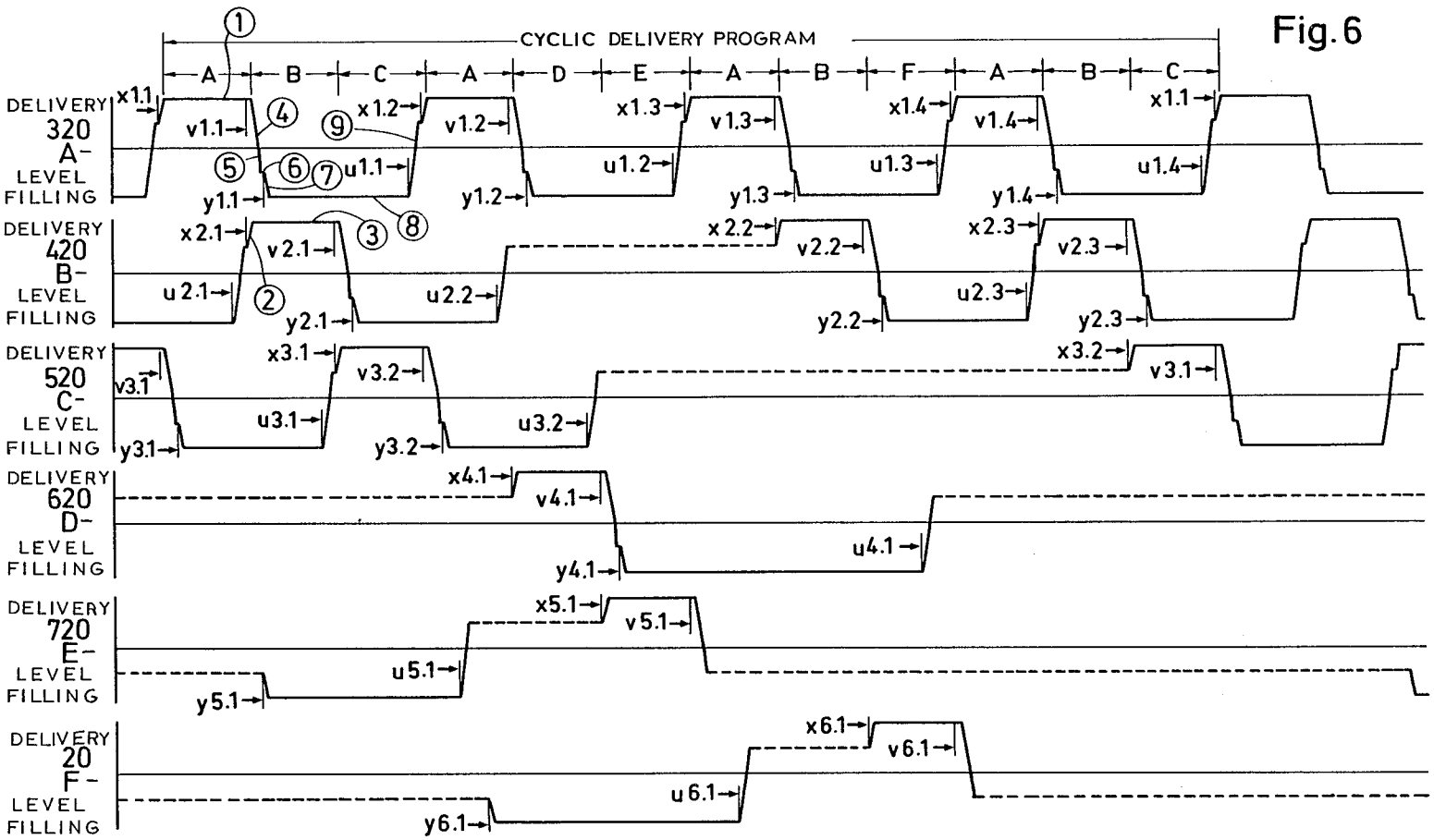

Additional features and advantages of the invention will be described in detail with reference to examples of embodiment illustrated in the drawings. In the drawing:

FIGS. 1*a* and 1*b* is a diagrammatic representation of cooling equipment in mine shafts in functional unity with tube-chamber feeder systems at four different transport levels in a mine-shaft for the hydraulic transport of solids;

FIG. 2 the timing- and operating-diagram of the control of the tube-chamber feeder system in accordance with FIG. 1 with continuous delivery and cooling-capacity distribution;

FIG. 3 the timing- and operating-diagram of the control of the tube-chamber feeder system in accordance with FIG. 1 but with different lengths and different fill-volumes of the individual tube chambers at the different levels;

FIGS. 4*a* and 4*b* is a diagrammatic representation of another layout for cooling equipment for mine-shafts, functionally combined with a tube-chamber feeder system for the hydraulic transport of solids;

FIG. 5 the timing- and working-diagram of the control of the installation in accordance with FIG. 4, depicting the possibilities for controlling the transport cycle and distribution of the cooling capacity and;

FIG. 6 the timing- and operating-diagram of the control of the installation in accordance with FIG. 4, depicting the distribution of the transport- and filling-capacities of the equipment.

SPECIFIC DESCRIPTION

FIG. 1 is a simplified diagrammatic representation of an installation for the hydraulic transport of solids from an underground mine shaft with a plurality of levels A, B, C and D at different depths below the surface which operates with a tube-chamber feeder system. At the same time, this installation is designed and set out in such a manner that it allows for the cooling of the atmosphere in the mine shaft and/or of the machinery which is installed therein at the various individual working levels A, B, C and D.

In the case of this installation there is a scrubber 101 located above the surface or at some other central site, with a device 102 for discharge and removal of the solids. The other end of the scrubber 101 is connected to the suction side of a pump 103, the pressure discharge side of which is connected either to a cooling tower 104 or else supplies clarified water directly to a refrigeration plant 106.

The clarified water passing out from the cooling tower 104 may be forwarded to the refrigeration plant 106 by means of the pump 105.

There is also an ice-production and -admixture plant 107 associated with the refrigeration plant 106. From the refrigeration plant 106 and also from the ice-production and -admixture plant 107, cold water is supplied by means of the pump 108 to the pipeline 110 which is coupled to the cold-water side of the tube chamber feeder system 201 which is furnished with three tube chambers 201*a*, 201*b* and 201*c*.

A return pipeline 109 connects the hot-water side of the tube-chamber feeder system 201 to the scrubber 101.

The tube-chamber feeder system 201 is preferably installed at an intermediate level of the mine shaft and is designed for continuous feed of the cold and hot water (the latter carrying the solids). It serves the purpose of stepping down the geodetic pressure for the pipelines and fittings where they are at greatly different depths in the mine shaft.

There is also a hot-water and sludge container 203 located on the intermediate level which is coupled to the hot-water side of the tube-chamber feeder system and is supplied with hot water by way of the mine shaft pipeline 205. The hot-water container 203 can also be supplied with top-up water through a pipeline 204 fitted with a gate valve which is controlled by means of the water-level measuring instrument 207.

The hot water pipeline 109 is also connected to the hot-water side of the tube-chamber feeder system 201 and this pipeline supplies the scrubber 101 which is above ground level with hot water and sludge.

A mine shaft pipeline 206 arises from the cold-water side of the tube-chamber feeder system 201 and this pipeline goes down past the levels A, B, C to the level D and is used for supplying cold water for the mining operations.

The mine shaft pipeline 205 is also laid down parallel to the mine-shaft pipeline 206 and it passes upward along levels C, B and A to reach the hot-water container 203 on the intermediate level and supply it with hot water.

The losses of water which occur in the mining operations can be compensated for in the hot-water container 203 through the pipeline 204 by way of the water-level regulating device 207 with, by way of example, water from the mine shaft or sludge.

The pump 202 of the tube-chamber feeder system 201 is used to circulate the water in the high-pressure circulation to which a tube-chamber 320, 420, 520 and 620 can be connected at each of the levels A, B, C and D respectively. Additional plant vessels are associated with tube-chamber 320 on level A. In particular there is a cold-water reservoir 301 located there and also a hot-water reservoir 302.

Cold water is supplied from the cold water reservoir 301 by the pump 303 to a water sprinkler system 307 which serves not only for the cooling of the atmosphere at level A, but can also scrub out solid dust particles from the air to form a sludge which drains away into the sludge bunker 308. From here the sludge is pumped by means of the pump 306 to the hot-water container 302 which may be connected to the tube-chamber 320 by way of a pump 304. The hot-water container 302 is provided with a water-level measuring device or water-level regulator 309. A water-level measuring device or water-level regulator 310 operates in conjunction with the cold-water reservoir 301. In addition to this there is a temperature switch 305 associated with the hot-water reservoir 302. The water-level measuring devices or water-level regulators 309, 310 are provided in order to control the supply of make-up water to the cold-water reservoir 301 as required by way of a pipeline 311, thereby eventually adding water to the hot-water side.

The tube-chamber 320 on level A is provided with two delivery gate valves 321 and 322. The delivery gate valve 321 is used to establish connection from time to time between tube-chamber 320 and the cold-water pipeline 206, whereas the delivery gate valve 322 establishes the connection between tube chamber 320 and the hot-water pipeline 205 at the same time. A filler gate valve 323 makes it possible to connect tube chamber 320 with the pressure side of the pump 304, whereas a filler valve 324 is used to establish connection between tube chamber 320 and the pipeline 328 which discharges into the cold-water reservoir 301. A pressure-relief gate valve 325 is also provided here and there is also a pressure-increase gate valve 326 as well as a contact manometer 327.

On level B the tube chamber 420 is provided with a cold-water reservoir 401 and a hot-water reservoir 402. Cold water is supplied from the cold water reservoir 401 by the pump 403 to a water sprinkler system 407 which acts in conjunction with the collection vessel 408 and serves for the cooling of the atmosphere. The water from the collection vessel 408 is transferred, by way of the pump 406, to the hot-water container 402 which, in turn, may be connected to the tube chamber 420 by way of a pump 404. The hot-water container 402 is provided with a water-level measuring device or water-level regulator 409, whereas a water-level measuring device or water-level regulator 410 operates in conjunction with the cold-water reservoir 401. The water-level measuring devices or water-level regulators 409, 410 are provided in order to control the supply of make-up water to the hot-water reservoir 402 and the cold-water reservoir 401 as required by way of a pipeline 411.

The tube chamber 420 on level B operates in a similar manner to tube chamber 320 on level A, with two delivery gate valves 421 and 422, two filler gate valves 423 and 424 as well as a pressure-relief gate valve 425, a pressure-increase gate valve 426 and a contact manometer 427. In addition to this, the tube chamber 420 is also provided with two temperature switches 428 and 429.

On level C, apart from the tube chamber 520, there are additional installation components. A cold-water reservoir 501 is present along with the hot-water reservoir 502. The cold-water reservoir 501 supplies cold water for a linear tubular heat exchanger 507 by way of the pump 503 and the hot water issuing from this heat exchanger 507 is fed into the hot-water reservoir 502. Hot-water can be supplied from the reservoir 502 to tube chamber 520 by means of a pump 504.

Water-level measuring devices or water-level regulators 509, 510 are provided in order to control the supply of make-up water to the hot-water reservoir 502 and the cold-water reservoir 501 as required by way of a pipeline 511. A temperature switch 505 acts in conjunction with hot-water reservoir 502. Here again, two delivery gate valves 521 and 522, two filler gate valves 523 and 524 as well as a pressure-relief gate valve 525, a pressure-increase gate valve 526 and a contact manometer 527 are provided for tube-chamber 520.

At the lowest level D there is likewise a cold-water reservoir 601 and a hot-water reservoir 602. A cooling tower 607 is supplied with cold water from cold-water reservoir 601 by means of a pump 603, and water is fed from the collection vessel of cooling tower 607 into hot-water reservoir 602 by means of a pump 606.

Hot water can be supplied from the hot-water reservoir 602 to tube chamber 620 by means of a pump 604.

Water-level measuring devices or water-level regulators 609, 610 are provided in order to control the supply of make-up water to the hot-water reservoir 602 and the cold-water reservoir 601 as required by way of a pipeline 611. A temperature switch 605 acts in conjunction with hot-water reservoir 602.

Here again, two delivery gate valves 621 and 622, two filler gate valves 623 and 624 as well as a pressure-relief gate valve 625, a pressure-increase gate valve 626 and a contact manometer 627 are provided for tube-chamber 620.

The tube chambers 320, 420, 520 and 620 on levels A, B, C and D can not only be used for the hydraulic conveying of the solid materials which are obtained at the respective levels but they also serve for the distribution of the necessary cooling capacity over the whole system.

If, as is shown in FIG. 1, the tube chambers 320, 420, 520 and 620 on levels A, B, C and D have corresponding structural dimensions or the same fill capacity, then use will be made as required of their switch-on frequency in each case for distribution of the cooling capacity. The more frequently a tube chamber is switched-on or operated, so much greater will be the cooling capacity available on the particular level which houses that tube chamber.

With every working cycle of the individual tube chambers 320, 420, 520 and 620, on the one hand cold water will be supplied to the relevant level A, B, C or D respectively from the mine shaft pipeline 206. On the other hand, the corresponding amount of hot water or of sludge, to which the solids to be transported have been added, will be drawn off and conveyed upward through the mine shaft pipeline 205. This method of working is controlled by alternately bringing into operation the delivery gate valves, the filler gate valves, the pressure relief gate valve and the pressure-increase gate valve which are associated with each individual tube chamber. Whereas, under such conditions, the two delivery gate valves regulate the activity of each tube-chamber in conjunction with the high-pressure circulation, the two filler gate valves serve the purpose of regulating their activity in conjunction with the low-pressure liquid circulation on the working level of the mine shaft on which the particular tube chamber is located.

The pressure-relief gate valve and the pressure-increase gate valve together with the associated contact manometer determine the regular sequence of operations in the domain of each individual tube chamber.

The tube chambers 320, 420, 520 and 620 of the installation as shown in FIGS. 1*a* and 1*b* are each coupled to their associated delivery gate valves 321, 322 and filler gate valves 323, 324 (and similarly for the other tube-chambers and the relevant gate valves) so that they operate on the counter-current principle and thus with mutually opposed directions for filling and delivery.

Thus, for example, when tube chamber 320 on level A is supplied with hot water from the low-pressure liquid circulation by the pump 304 through the filler gate valve 323, and the cold water which is present in tube chamber 320 is forced out through filler gate valve 324 into the cold-water reservoir 301, then the cold water from the mine shaft pipeline 206 passes through the delivery gate valve 321 into tube chamber 320 and displaces the hot water which had been filled into the tube chamber 320 so that it flows out through the delivery gate valve 322 into the mine shaft pipeline 205.

However, it is also possible to imagine that the tube chambers 320, 420, 520 and 620 could be installed in such a manner that they could be operated on the co-current or parallel flow principle. In the example shown in FIG. 1, it would only be necessary for this purpose to change over the connections of the pipelines of each tube chamber with the mine shaft pipelines 205 and 206 along with the delivery gate valves contained therein.

So that an optimal thermal effectiveness of the whole mining installation may be achieved, provision must be made at specified times for continuous flow of water in the cold-water pipelines 110 and 206, as well as in the hot-water pipelines 109 and 205, which cannot be interrupted during the flow intervals by water of a different temperature. This method of operation is ensured with the installation depicted in FIG. 1 because it operates with a tube chamber feeder system 201 which includes at least two tube chambers 201*a*, 201*b*, 201*c* and in which, therefore, the delivery time is equal to, or greater than, the sum of the filling time and the switching time of the gate valves which are present.

In order to achieve the desired continuity in the delivery pipelines it is essential to empty the tube chambers 201*a*, 201*b*, 201*c* immediately one after the other.

The regulation of the sequence of operations is effected by way of a central control system which has sequence switching.

With this set-up, the signals for control of the tube chamber operations can come from:

- a program with timing elements either sequentially or by taking the cooling capacity distribution into account.
- the temperature switches 305, 405, 505 or 605 on the hot-water reservoirs 302, 402, 502 or 602, for example when these reservoirs are filled.
- the volume-measurement instruments 310, 410, 510 or 610 when the cold-water reservoirs 301 to 601 are emptied.
- integrators 611, for example in the collaboration of measurement and counter instruments.
- temperature switches, for example 428 and/or 429, on the tube chambers, for example tube chamber 420, which respond to variations in temperature.

For the control process, it is also necessary to take into account:

- the signals from limit switches on the shut-off devices which include the filler gate valves 321, 322 . . . 621, 622, the delivery gate valves 323, 324 . . . 623, 624, the pressure-relief gate valves 325 . . . 625 and the pressure-increase gate valves 326 . . . 626;
- the contact manometers 327, 427, 527 and 627. These detect the pressure increase before the delivery and the pressure decrease before the filling in each of the respective tube chambers 320 . . . 620 involved.

The cold water which is forced out by the hot water or the sludge during the filling of the tube chambers 320, 420, 520 and 620 need not be supplied unconditionally to the respective cold-water reservoirs 301, 401, 501 and 601 of the low-pressure liquid circulation but it can also be supplied directly to the cooling equipment 307, 407, 507 and 607 from which it can then be conveyed to the hot-water reservoirs 302, 402, 502 and 602 respectively.

FIG. 2 is the timing- and operating diagram of a cyclic delivery system in the installation depicted in FIG. 1.

In this diagram the time required for delivery with a tube chamber is designated as $T_{Fo}$ and the time required for filling a tube chamber is designated as $T_{Fu}$. The switching time $T_{SCH}$ is the sum of the operating times of the shut-off devices which is required for switching-over a tube-chamber from delivery to filling or conversely from filling to delivery. This also includes the time required for pressure equilibration and the time required for pressure relief.

Within the time-switching period $T_{SCH}$, up to eight steps, for example, as indicated by the numbers in circles in FIG. 2, are executed.

The lapse time between filling and delivery, and between delivery and filling, decreased by half of the applicable switching-time $T_{SCH}$ is designated in the diagram as the waiting, or readiness, time $T_B$.

The delivery rhythm for the individual tube-chambers 320, 420, 520 and 620 follows a cyclic delivery program, which is indicated in FIG. 2 by the sequence A-B-C-D.

Accordingly, the total cooling capacity which is available to the whole mining installation is divided up into six parts. With this arrangement, the cooling capacity is available to the tube-chambers 320, 420, 520 and 620 on the individual levels A, B, C, and D, depending upon the frequency of coupling-in of said tube chambers and, in accordance with the delivery cycle which may be gleaned from the diagram, this is actually distributed as:

1/6 for level A,
2/6 for level B,
2/6 for level C and
1/6 for level D.

As already mentioned, each tube-chamber 320, 420, 520 and 620 has its own individual filling circulation formed by a low-pressure liquid circulation.

With equal rates of delivery and filling, the filling time $T_{Fu}$ and delivery time $T_{Fo}$ are equal, as indicated for level A and level B.

The filling time $T_{Fu}$ may, however, be shorter than the delivery time $T_{Fo}$, as indicated for level C.

The filling time $T_{Fu}$ may, however, be longer than the delivery time $T_{Fo}$, as indicated for level D.

The waiting, or readiness, times $T_B$ can come after the filling operation, as shown for level A. However, they can also occur before the filling operation, as indicated for level B. Lastly, it is also possible for these waiting periods of time $T_B$ to occur both before and after the filling operation, as may be recognized in the diagram for level C.

Each of the tube-chambers 320, 420, 520 and 620 can be under delivery pressure during the waiting time $T_B$, as indicated for level A, or else they may be under filling pressure, as indicated for level B. Lastly, they can also be either open or closed during the waiting time $T_B$.

Whereas the installation, in accordance with the timing- and operating diagram shown in FIG. 2, operates with tube chambers of similar size on the various levels A to D, the timing- and operating diagram in FIG. 3 is for an installation which has tube chambers 320, 420, 520 and 620 of different sizes at the different levels A to D.

Here too the cyclic delivery program goes through the stages A-B-C-D, so that the distribution of the cooling capacity is 1/6 for level A,
2/6 for level B,
2/6 for level C and
1/6 for level D.

The installation illustrated in FIG. 4 for hydraulic transport of solids out of underground mine-shafts and for cooling of the atmosphere and/or of the machinery installed therein at the various levels of this mine shaft differs from that illustrated in FIG. 1 primarily because it is designed for operation at six levels A to F. Thus it operates with not only four tube chambers 320, 420, 520 and 620 but it has two additional tube chambers 720 and 820 for the two extra levels E and F.

Compared with the installation illustrated in FIG. 1, the installation illustrated in FIG. 4 is also different in that the tube chambers 520, 620 and 820 are designed for counter-current operation, whereas the tube-chambers 320, 420 and 720 are designed for co-current operation. Consequently a different arrangement of the delivery gate valves, the filler gate valves, the pressure-relief gate valve and the pressure-increase gate valve is necessitated.

It may also be gleaned from FIG. 4 that this installation operates without a tube chamber feeder system 201 installed at an intermediate level as indicated in FIG. 1, and thus its refrigeration plant 106 has a direct functional connection with the mine-shaft pipelines 205 and 206.

The low-pressure liquid circulations, which are installed at the different levels A to F, at least have a structural configuration similar to the low-pressure liquid circulations of the installation illustrated in FIG. 1. Consequently they act in conjunction with their associated tube chambers 320, 420, 520, 620, 720 and 820 in a similar manner to that already described for the first installation.

The distribution of the cooling capacity over the whole installation as illustrated in FIG. 4 at the individual levels A, B, C, D, E and F of the mine shaft is here primarily and fundamentally dependent upon the different dimensions or different volumetric capacities of the tube-chambers 320, 420, 520, 620, 720 and 820 which are installed at the respective levels. It will be seen, for example, that the tube-chambers 320, 420, 520 and 620 have similar dimensions and similar fill-volumes. In contrast to this, the size and fill-volume of tube chamber 720 is smaller, and the size and fill-volume of tube chamber 820 is greater than those of the four other tube chambers.

The timing- and operating-diagram for the regulation of the delivery rhythm in the installation illustrated in FIG. 4 is presented in FIG. 5. It may be recognized here that the regulation of the delivery rhythm for the individual tube-chambers 320, 420, 520, 620, 720 and 820 is effected by means of the timing elements a, b, c, d, e, f which all commence at a common null-point.

Since the course of events is periodical, the null-point line in FIG. 5 which is located at the commencement of delivery from the tube chamber 320 can be selected to be at any other point of time in the operating cycle.

In addition, it may also be gleaned from FIG. 5 that the regulation of the delivery rhythm for the tube chambers 320 to 820 can also take place by way of the timing elements u, v, w, x, y and z which are coupled in series.

Instead of the regulation by the timing elements a to f or u to z, it is possible to use the signals which come from the volume-measurement instruments, thermal contacts, integrators and computers which are associated with the tube chambers 320 to 820 or the low-pressure liquid circulations connected to them, as already discussed in relation to the installation illustrated in FIG. 1.

With the lay-out of the installation illustrated in FIG. 4, its cooling capacity may be subdivided into 12 parts, for example on the basis of the given fill-volumes of the various tube-chambers 320 to 820 on the individual levels A to F, in the following manner:

2/12 on level A,
2/12 on level B,
2/12 on level C,
2/12 on level D,
1/12 on level E and
3/12 on level F.

However, in accordance with FIG. 6, it is also possible to organize the cooling capacity of the installation illustrated in FIG. 4 with a cyclic delivery program with twelve stages, and this may actually be done, for example, with the sequence of stages A-B-C-A-D-E-A-B-F-A-B-C.

In relation to the switching frequency for the individual tube-chambers 320 to 820, the cooling capacity which is divided into 12 parts is accordingly distributed over the individual levels A to F in the following manner:

4/12 on level A,
3/12 on level B,
2/12 on level C,
1/12 on level D,
1/12 on level E and
1/12 on level F.

Naturally, the prerequisite for this distribution of the cooling capacity is that, with the installation illustrated in FIG. 4, the tube chambers 320 to 820, installed on all the levels A to F, should be similar in size and fill-volume.

With the installation illustrated in FIG. 4, the delivery is effected continuously.

The rapid transition of the delivery, for example from tube chamber 320 to tube chamber 420, that is to say, from the end of the delivery by tube chamber 320 to the commencement of the delivery by tube chamber 420, is indicated in FIG. 6 in the following fashion:

Step 1: Tube chamber 320 is delivering. Signal v1.1 initiates the switching-off of the delivery cycle in tube chamber 320. Signal x2.1 initiates the switching-on of the delivery cycle in tube chamber 420.

Step 2: The delivery gate valve of tube chamber 420 opens.

Step 3: Tube chamber 420 starts delivery.

Step 4: The delivery by tube chamber 320 is ended with the closure of its delivery gate valve and its pressure-increase gate valve.

The simultaneous timing of the signals v and x guarantees the continuity of the delivery in all installations with at least two tube-chambers. However, in the case of installations with only two tube-chambers, the continuity of delivery is cannot be guaranteed, if the sum of the filling-time $T_{Fu}$ and the switching-time $T_{SCH}$ is greater than the delivery-time $T_{Fo}$. In this instance, the x-signals actually occur at a later time.

Because, in accordance with FIG. 4, the levels A to F have their own individual filling-circulation, the switching-on and -off of the filling operation may be represented as:

Step 5: Pressure-relief valve for tube chamber 320 opens.

Step 6: Contact manometer detects the filling-pressure. Signal y1.1 initiates the filling operation.

Step 7: Filling gate valve of tube chamber 320 opens.

Step 8: Tube chamber 320 fills. Signal u1.1 initiates the end of the filling operation of tube chamber 320.

Step 9: The filling operation for tube chamber 320 is ended with the closure of the filler and pressure-relief gate valves.

In the timing- and operating-diagram in accordance with FIG. 6, each of the u signals characterizes the end of the filling operation for a tube chamber. Each of the v signals mark the introduction to the ending of the delivery operation by the tube-chamber involved. The x signals initiate the commencement of the delivery operation by the relevant tube chamber and the y signals represent the initiation of the commencement of the filling operation.

The signals which influence the six different tube-chambers are labelled with characterizing numbers 1, 2, 3, 4, 5, 6, whereas the frequency of the signals occurring during an operating cycle are distinguished by the additional suffixed numbers 1, 2, 3, 4. The steps 1 to 9 listed previously are indicated in FIG. 6 by numbers 1 to 9 enclosed in circles.

The signals u, v, x and y are execution signals from the central control system. They obtain their information signals from:

the delivery program,
the timing elements,
integrators,
temperature switches,
volume- or weight-measurement instruments,
the limit switches of shut-off devices and
contact manometers.

From the technical procedural point of view, it is important, not only for installations such as illustrated in FIG. 1, but also for those such as illustrated in FIG. 4, that the cold water which serves as the cooling liquid should be first of all fed from the feeder system into the tube chambers 320 to 620, or tube chambers 320 to 820, as the case may be, which are located on the different levels A to D, or A to F respectively, following which each of these tube chambers should be supplied separately, if the occasion demands, with hot, or re-cycled, water obtained from the equipment which required cooling, from their own low-pressure liquid circulation for the purpose of expelling the cooling liquid towards the equipment requiring cooling. In the course of this procedure, the cooling liquid is cycled intermittently into the different tube chambers 320 to 620, or 320 to 820, as the case may be, from where it is then conveyed in the low-pressure circulations to the equipment requiring cooling. After having been heated there the water is once again returned to the tube chambers 320 to 620, or 320 to 820, as the case may be, for re-circulation and it is finally discharged at the surface of the mine.

After the heated liquid is discharged from the equipment which had been cooled by it, but before filling it into the tube chambers 320 to 620, or 320 to 820, solid material can be mixed into it for the purpose of hydraulic transport.

The cooling procedure which has been dealt with exhaustively in the foregoing description has the considerable advantage that it provides an optimal, and therewith economical, method of operation of the installation with relatively low expenditure on control technology, in such a manner that fluctuations in the operating pressure do not continually recur. On the different levels A to D, or A to F, as the case may be, it is possible to implement the relocation of the mining equipment which requires cooling, necessitated by the progress of the mining operations, without any difficulty.

The installation may be modified at any time without any problems because it can be operated with every practicable number of tube chambers, provided that at least two such tube chambers are utilized in any one installation.

What is claimed is:

1. A method of cooling a mine shaft having a plurality of levels, comprising the steps of:

(a) providing at each of said levels, a respective tube chamber, a respective low-pressure circulation path for supplying a cooling liquid to equipment to be cooled and carrying away liquid heated at said equipment, and respective means connecting said low-pressure circulation path with the respective tube chamber;

(b) feeding from ground level respective quantities of said cooling liquid at high pressure to the respective tube chambers and regulating the quantities fed to the respective tube chambers in accordance with cooling requirements of the respective levels; and (c) displacing cooling liquid from said tube chambers at the respective levels to said equipment at the respective level at least in part by said liquid heated at said equipment by connecting each of said low-pressure circulation paths to the respective tube chamber to force out therefrom the cooling liquid with said liquid heated at the equipment of the respective level.

2. The method defined in claim 1 wherein the quantities fed to the respective tube chambers of the respective levels is regulated by selective determination of the volumetric capacities of the tube chambers selectively disposed at said levels.

3. The method defined in claim 1 wherein the quantities fed to the respective tube chambers of the respective levels is regulated by selectively controlling the numbers of successive filling operations of the tube chambers at said levels.

4. An apparatus for cooling a mine shaft having a plurality of levels and respective equipment at each level requiring cooling, comprising:

at least one tube chamber at each of said levels;

means forming a respective low-pressure circulation path at each level for supplying a cooling liquid to respective equipment to be cooled and carrying away liquid heated at said equipment;

respective means at each level connecting each of said low-pressure circulation paths with the respective tube chamber;

a tube-chamber feeder system connected in common to all of said tube chambers and extending from ground level, including refrigerating means and a high-pressure cooling liquid pipeline extending downwardly to all of said levels, for delivering respective quantities of said cooling liquid at high pressure to the respective tube chambers and regulated in accordance with cooling requirements of the respective levels; and means for displacing cooling liquid from said tube chambers at the respective levels to said equipment at the respective level at least in part by said liquid heated at said equipment by connecting each of said low-pressure circulation paths to the respective tube chamber to force out therefrom the cooling liquid with said liquid heated at the equipment of the respective level.

5. The apparatus defined in claim 4 wherein the tube chambers at the various levels are different in length and volumetric capacities from one another.

6. The apparatus defined in claim 4 wherein the tube chambers at the various levels are identical in length and volumetric capacity, each of said tube chambers being provided with means for enabling filling operations with said cooling liquid to be carried out at different frequencies for said tube chambers of different levels.

7. The apparatus defined in claim 4, further comprising respective monitoring means at each level which can include instruments for measuring pressure and for measuring temperature, and including limit switches for shut-off devices, timing relays integrators and instruments for measuring weight and volume associated with the respective tube chamber, and a central control system responsive to all of said monitoring means for controlling said tube-chamber feeder system.

8. The apparatus defined in claim 4 wherein each of said tube chambers at a respective level is selectively connectable with said high-pressure cooling liquid pipeline by respective delivery gate valves and is selectively connectable with the respective low-pressure circulation path by respective filler gate valves.

9. The apparatus defined in claim 8, further comprising:

a respective pressure-relief gate valve and a pressure-increase gate valve between at least one of said delivery gate valves and at least one of said filler gate valves of each of said tube chambers; and a respective manometer connected between the pressure-relief and pressure-increase gate valves of each of said tube chambers.

10. The apparatus defined in claim 9 wherein each of said tube chambers is constructed and arranged to be supplied alternately with cold and hot liquids in counterflow.

11. The apparatus defined in claim 9 wherein each of said tube chambers is constructed and arranged to be supplied alternately with cold and hot liquids in codirectional flow.

* * * * *